350-357 SR
11/29/83 XR 4,418,346

United States Patent [19] [11] 4,418,346
Batchelder [45] Nov. 29, 1983

[54] METHOD AND APPARATUS FOR PROVIDING A DIELECTROPHORETIC DISPLAY OF VISUAL INFORMATION

[76] Inventor: J. Samuel Batchelder, 85 Allison Rd., Katonah, N.Y. 10536

[21] Appl. No.: 265,637

[22] Filed: May 20, 1981

[51] Int. Cl.[3] ..... G09G 3/34
[52] U.S. Cl. ..... 340/787; 340/783; 350/357
[58] Field of Search ..... 340/787, 783; 350/357, 350/363

[56] References Cited

U.S. PATENT DOCUMENTS

| | | | |
|---|---|---|---|
| 465,822 | 12/1891 | Lowden . | |
| 895,729 | 8/1908 | Cottrell . | |
| 2,417,850 | 3/1947 | Winslow . | |
| 2,835,632 | 5/1968 | Kollsman . | |
| 2,872,407 | 2/1959 | Kollsman . | |
| 2,914,453 | 11/1959 | Wennerberg . | |
| 3,144,533 | 8/1964 | Donath . | |
| 3,152,062 | 10/1964 | Clusius . | |
| 3,162,592 | 12/1964 | Pohl . | |
| 3,431,441 | 3/1969 | Shair . | |
| 3,488,531 | 1/1970 | Rosensweig . | |
| 3,634,853 | 1/1972 | Hedges . | |
| 3,687,834 | 8/1972 | Candor . | |
| 3,795,605 | 3/1974 | Candor . | |
| 3,806,893 | 4/1974 | Ohnishi et al. . | |
| 3,906,415 | 9/1975 | Baker . | |
| 3,966,575 | 6/1976 | Candor . | |
| 3,980,541 | 9/1976 | Aine . | |
| 4,001,102 | 1/1977 | Batha et al. . | |
| 4,062,009 | 12/1977 | Raverdy et al. | 340/787 |
| 4,079,368 | 3/1978 | DiStefano . | |
| 4,126,854 | 11/1978 | Sheridon | 340/787 |
| 4,146,454 | 3/1979 | Haber . | |
| 4,160,141 | 7/1979 | Graf . | |
| 4,164,460 | 8/1979 | Jordan et al. . | |
| 4,203,106 | 5/1980 | Dalisa et al. | 340/787 |
| 4,226,688 | 10/1980 | Kedem et al. . | |
| 4,305,807 | 12/1981 | Somlyody | 340/787 |

FOREIGN PATENT DOCUMENTS

| | | | |
|---|---|---|---|
| 2951569 | 8/1980 | Fed. Rep. of Germany | 340/787 |

OTHER PUBLICATIONS

*Recent Developments in Light Modulating Displays;* Lewis et al, Electronic Equipment News; pp. 22–23, Jun. 1975.

Electrical Force Effects in Dielectric Liquids, Pickard, Dielectrics 6, (1965), pp. 3–39.

*Primary Examiner*—Marshall M. Curtis
*Attorney, Agent, or Firm*—Parmelee, Bollinger & Bramblett

[57] ABSTRACT

The present invention provides a method and apparatus for selectively displaying visual information using dielectrophoretic forces resulting from the application of a non-uniform electrical field to a dielectric material. Specifically, first and second visually distinguishable materials having different dielectric constants are provided within an enclosure that is formed, at least in part, from a transparent material. A non-uniform electrical field is applied to the materials causing relative translational movement thereof as a result of dielectrophoretic forces generated by the non-uniform field. Because the first and second materials are visually distinguishable and their relative positions are determined by the dielectrophoretic forces of the electrical field, adjustment of the magnitude of those forces adjusts the arrangement of the two materials. Thus, the apparatus provides a selectively adjustable display for visual information.

21 Claims, 8 Drawing Figures

METHOD AND APPARATUS FOR PROVIDING A DIELECTROPHORETIC DISPLAY OF VISUAL INFORMATION

BACKGROUND OF THE INVENTION

The present invention is based on the phenomenon of dielectrophoresis—the translational motion of neutral matter caused by polarization effects in a non-uniform electric field. The dielectrophoresis phenomenon was first recorded over 2500 years ago when it was discovered that rubbed amber attracts bits of fluff and other matter. Over 300 years ago, it was observed that water droplets change shape as they approach a charged piece of amber. The basic concept of dielectrophoresis is examined in detail in a text entitled *Dielectrophoresis* by Herbert H. Pohl, published in 1978 by the Cambridge University Press. Further discussion of this phenomenon also can be found in an article by W. F. Pickard entitled "Electrical Force Effects in Dielectric Liquids," *Progress in Dielectrics* 6 (1965)—J. B. Birks and J. Hart, Editors.

All known practical applications of the dielectrophoresis phenomenon have been directed to either separators or clutches. For example, U.S. Pat. No. 1,533,711 discloses a dielectrophoretic device that removes water from oil; U.S. Pat. No. 2,086,666 discloses a dielectrophoretic device which removes wax from oil; U.S. Pat. No. 2,665,246 discloses a dielectrophoretic separator used in a sludge treatment process; U.S. Pat. No. 2,914,453 provides for separation of solid polymeric material from fluid solvents; U.S. Pat. No. 3,162,592 provides for separation of biological cells; U.S. Pat. No. 3,197,393 discloses a separator using centripetal acceleration and the dielectrophoretic phenomenon; U.S. Pat. No. 3,304,251 discloses dielectrophoretic separation of wax from oil; U.S. Pat. No. 3,431,441 provides a dielectrophoretic separator which removes polarizable molecules from plasma; U.S. Pat. No. 3,980,541 discloses separation of water from fluid; and U.S. Pat. No. 4,164,460 provides for removal of particles from a liquid. U.S. Pat. Nos. 3,687,834; 3,795,605; 3,966,575; and 4,057,482 disclose other dielectrophoretic separators for removing particulates and water from a fluid. Other separators, not necessarily dielectrophoretic separators, are disclosed in U.S. Pat. Nos. 465,822; 895,729; 3,247,091 and 4,001,102.

U.S. Pat. No. 2,417,850 discloses a clutch mechanism using the dielectrophoretic phenomenon.

The object of the present invention is to provide a method and apparatus for selectively displaying visual information using the dielectrophoretic effect. A variety of electronic display devices are well known in the art. None of these, however, offer the possible combination of high contrast, high resolution, simple interfacing, and low cost which could be achieved with a dielectrophoretic display in accordance with the present invention. The premier display today is the CRT (cathode ray tube), which provides good resolution, color, and high speed, but which suffers from the effects of ambient light, bulk, complex interfacing, and expense. LED (light emitting diode) display arrays have high speed and are simple to multiplex, but they are inefficient, and they too suffer from ambient light and expense. LCD's (liquid crystal displays) have low power consumption and low cost, but they suffer from poorer contrast, grey scale, speed, and resolution. Other techniques, such as plasma panels, neon discharge tubes, and others, have similarly proved themselves somewhat deficient in at least one of these criteria for an electronic display: efficiency, reliability, contrast, speed, resolution, insensitivity to ambient light, ease of interfacing, and cost. The present invention employs a technique which is new to electronic displays. The effect used to manipulate the display is dielectrophoresis, or the force exerted on electrically neutral matter by non-uniform electric fields.

SUMMARY OF THE INVENTION

An apparatus for selectively displaying visual information includes a housing formed, at least in part, from a transparent or light transmissive material. At least first and second visually distinguishable materials having different dielectric constants are enclosed within the housing, and means for applying a non-uniform electrical field across the materials is provided. Application of the non-uniform electrical field results in relative translational movement of the two materials as a result of dielectrophoretic forces generated by the field. Because the relative movement of the materials depends in part on the magnitude of the non-uniform field, adjustment of the field selectively varies the relative positions of the materials. Since the two materials are visually distinguishable, selective rearrangement of their relative positions provides different displays of visual information.

DESCRIPTION OF THE PREFERRED EMBODIMENTS

Figure 1:
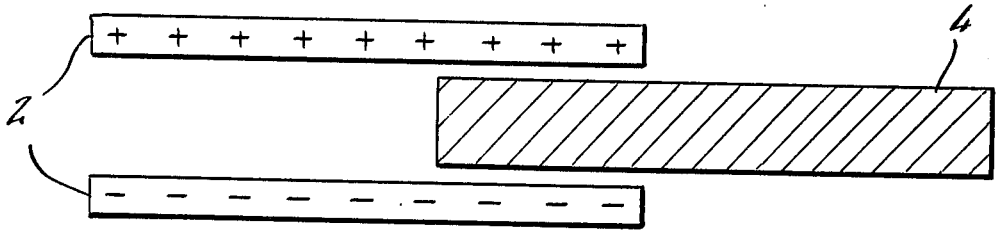
FIG. 1 diagrammatically illustrates a dielectric material being moved between a pair of capacitor plates in accordance with one embodiment of the present invention.

This invention utilizes the phenomenon known as dielectrophoresis, or the motion of electrically neutral matter in non-uniform electric fields caused by polarization effects in the neutral matter. Matter is polarizable to the extent that electric charges are mobile inside the material, specifically to the extent that the electric charge can respond to external electric fields. The polarizability of material, at low frequencies, is measured by the dielectric constant. For example, the dielectric constant of a vacuum, which has no mobile charges, is one, and the dielectric constant of a metal, which contains charges that are so mobile that the material is termed a conductor, is infinite. Since the low frequency dielectric constant of a conductor is not a directly measurable quantity, moderate and good conductors are generally not considered dielectric materials. However the induced polarization in a conductor due to an external electric field is approximately the same as the induced polarization in a non-conducting material with a large but finite dielectric constant. The induced polarization determines the strength of the attractive force, so a conductor may properly be considered as being subject to a dielectrophoretic force. It is well known that a material with a higher dielectric constant will experience a force tending to move it into a region of stronger electric field, and in the process it will displace a material with a lower dielectric constant. Such a process is shown in FIG. 1; a parallel plate capacitor, 2, with some potential difference between its two plates, will contain an electric field between the two plates. A slab of material, 4, having a higher dielectric constant than the surrounding medium, will be attracted into the region between the capacitor plates. The slab will move into the region between the plates at a rate determined by a variety of factors: its dielectric constant; the dielectric constant of the surrounding material; the voltage and geometry of the capacitor; the viscosity of the surrounding material; and any other forces which may be acting on the slab, such as gravity and surface interactions.

Figure 2:
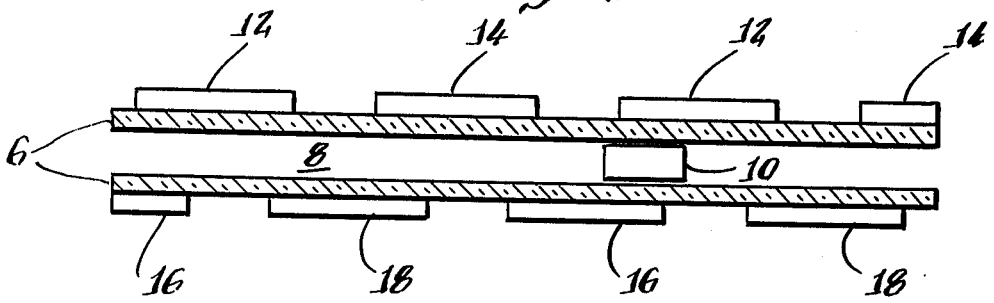
FIG. 2 diagrammatically illustrates a dielectric material disposed between a plurality of different pairs of capacitor plates.

Elaborating on this geometry, instead of a single pair of capacitor plates, a sequence of capacitive electrodes may be provided, as shown in FIG. 2. Two insulating plates 6 in a surrounding medium 8 enclose a bubble 10 of a higher dielectric material and carry on their non-opposed surfaces electrodes 12, 14, 16, and 18. Those electrodes which carry the same reference numeral are electrically connected. This may be referred to as a ladder electrode geometry. With a voltage V+ applied to electrodes 12 and 16 and V− applied to electrodes 14 and 18, the bubble 10 of higher dielectric material will have a stable position between electrodes 12 and 18. If V+ is applied to electrode 18 and V− to electrodes 12, 14 and 16, the bubble 10 of high dielectric material (hereafter referred to as the bubble) moves to the right, finding a stable position over electrode 18, as shown in the second diagram from the top of FIG. 2A. This process can be continued, as shown by the sequence of diagrams in FIG. 2A, by applying the voltages given in Table 1, below, to the various electrodes, causing the bubble to move reversibly to the right. The voltages on the electrodes in the ninth step are the same as in the first step, indicating that the system has returned to its initial condition with the exception that the bubble has been moved to the right.

TABLE 1

| Electrode | Step 1 | 2 | 3 | 4 | 5 | 6 | 7 | 8 | 9 |
|---|---|---|---|---|---|---|---|---|---|
| 12 | V+ | V− | V+ | V− | V+ | V− | V+ | V+ | V+ |
| 14 | V− | V− | V− | V+ | V− | V− | V− | V− | V− |
| 16 | V+ | V− | V− | V− | V+ | V+ | V− | V− | V+ |
| 18 | V− | V+ | V+ | V− | V− | V− | V+ | V− | V− |

Figure 3:
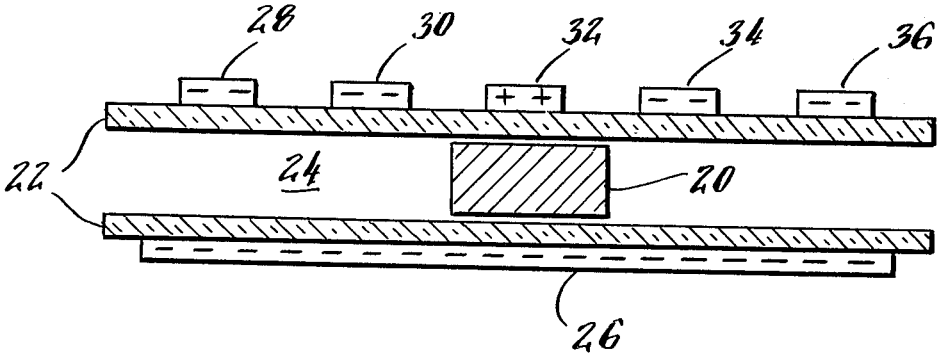
FIG. 3 diagrammatically illustrates another embodiment of the present invention in which a single capacitive plate is disposed on one side of a dielectric material and a plurality of capacitive plates are disposed on the opposite side.
Figure 2H:
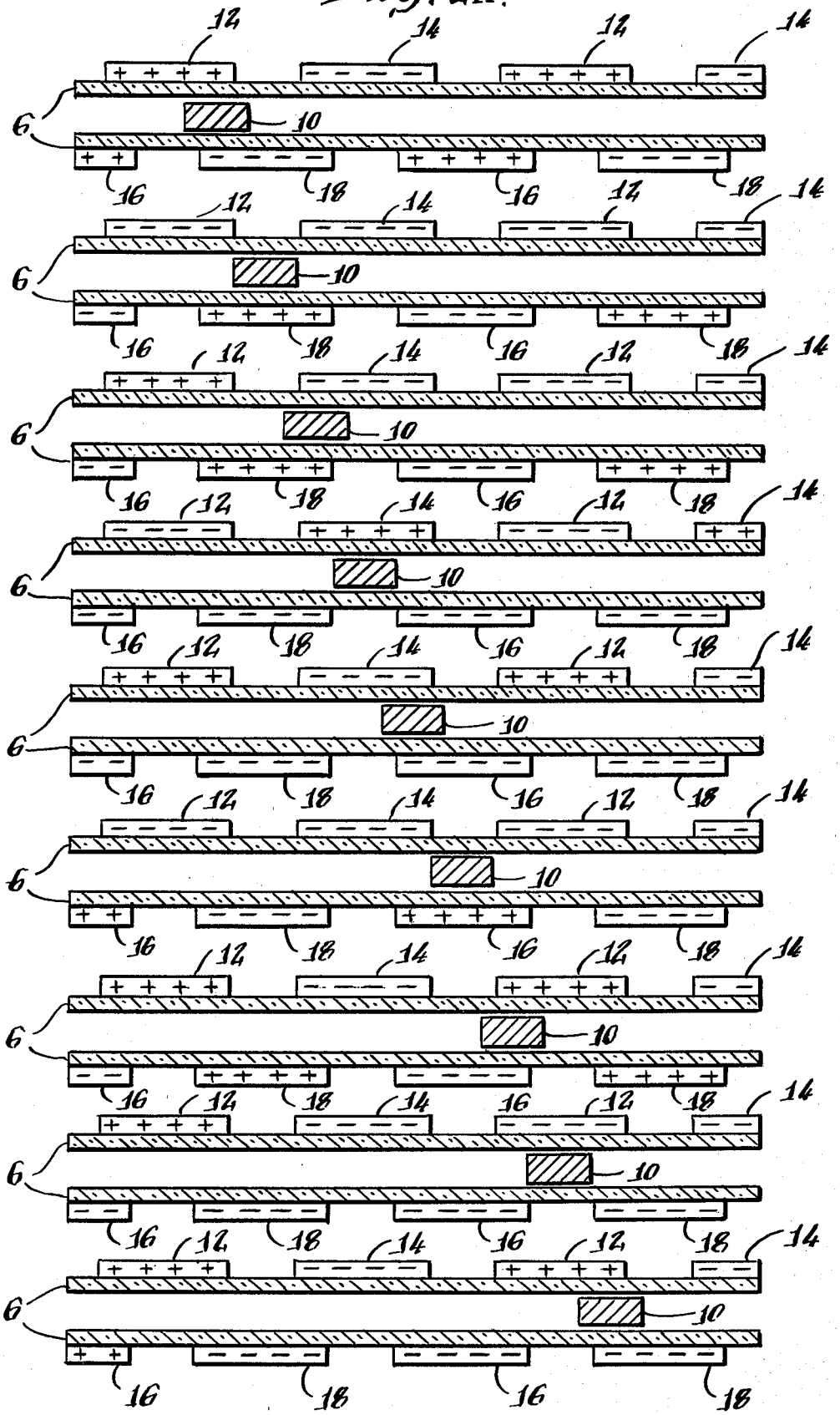
FIG. 2A diagrammatically illustrates sequential movement of the dielectric material of FIG. 2 by varying the charges on the pairs of capacitor plates.

A variation on the ladder electrode design is called the half-ladder, and is shown in FIG. 3. The higher dielectric bubble 20 is surrounded by insulating layers, 22, on which are mounted the electrodes. The bubble is surrounded by a low viscosity low dielectric medium, 24. In this case there is a single electrode, 26, mounted on one side, and a sequence of electrodes, 28, 30, 32, 34 and 36, mounted on the opposing insulator. As in the case of the ladder design, sequential electrical excitation of the upper electrodes in FIG. 3 can cause the position of the higher dielectric bubble to be manipulated.

Figure 4:
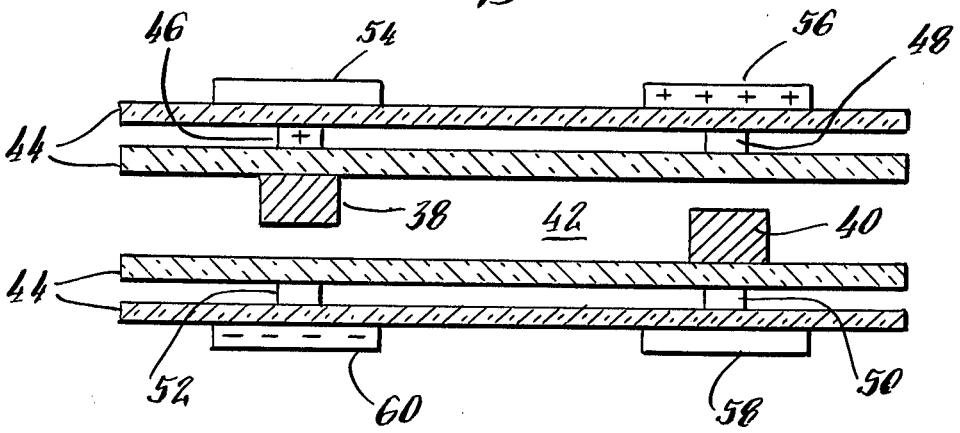
FIG. 4 diagrammatically illustrates a further embodiment of the present invention in which translational movement of a dielectric material is caused in a plane perpendicular to the plane of the electrode array.

Alternative electrode configurations create bubble movement perpendicular to the plane of the electrode array rather than parallel to it. An example of such a configuration is shown in FIG. 4. High dielectric bubbles, 38 and 40, are surrounded by a lower dielectric medium, 42, and by insulators, 44. Inner electrodes, 46, 48, 50, and 52, are substantially narrower than their outer counterparts, 54, 56, 58 and 60. Now if, for example, electrode 46 is held at V+ and electrode 60 at V−, the electric field density will be strongest near the smaller electrode 46, so that the bubble 38 will rise to reside in the region of the strongest field. Similarly, if electrode 56 is held at V+ and electrode 50 at V−, the bubble 40 will sink to approach electrode 50.

The potentials of various electrodes have been denoted by the d.c. voltage levels V+ and V− for the sake of clarity. The sign of the field, which is determined by the relative potentials on both electrodes, is immaterial, because, for electrically neutral bubbles of dielectric material, the force that they experience due to the voltages on the electrodes is attractive and independent of sign. In practice, the dielectric media have some non-negligible electronic or ionic conductivity. Ions in the surrounding medium will migrate under the influence of the electrode fields and configure themselves so as to shield the dielectric bubble from these external fields. This is usually an undesirable effect and the actual voltage applied to the electrodes is made constant in absolute value but is also caused to oscillate in time at a rate sufficient to decrease ionic shielding to an acceptable level.

While the above discussion has referred to a higher dielectric bubble surrounded by a lower dielectric medium, the opposite possibility also exists. If a bubble of a lower dielectric medium is immersed in a surrounding higher dielectric, it will tend to be repelled by dielectrophoretic forces. FIGS. 2–4 also include insulators placed between the electrodes and the mobile dielectric materials. These are not necessary if the conductivity of the dielectric media is low enough, and if there are no detrimental interactions between the electrode material and the dielectric media.

Figure 5:
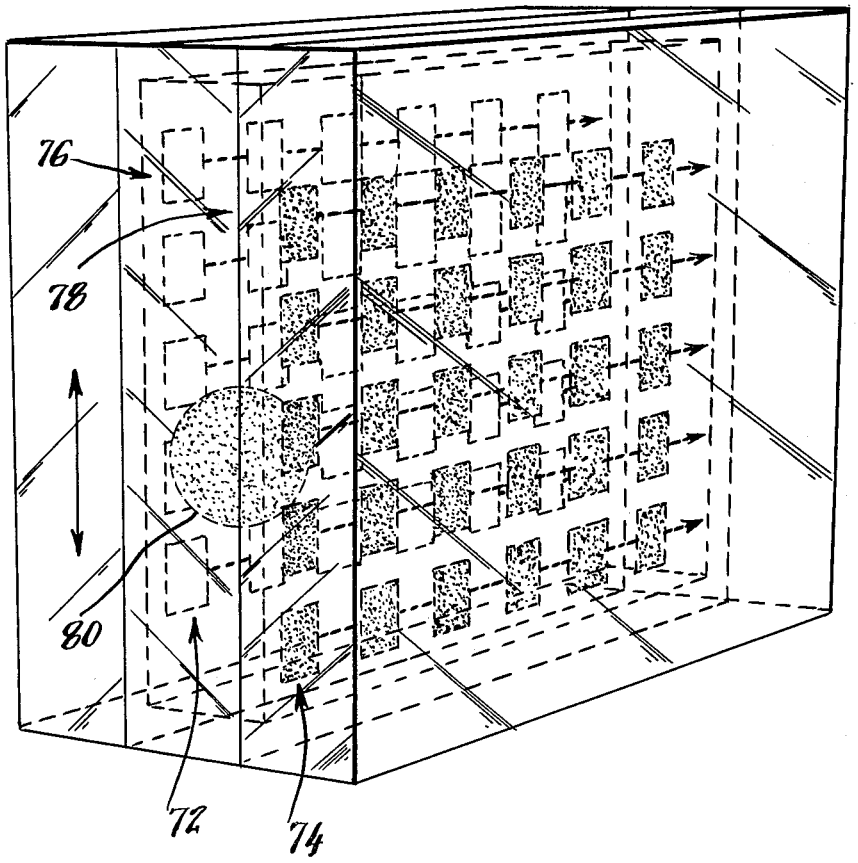
FIG. 5 is a perspective view of a two-dimensional "ladder" display in accordance with the present invention.

The electrode arrays pictured in FIGS. 1–4 allow for manipulation of the bubble position in essentially only one dimension. However, it is clear that such techniques can be extended to give manipulation capability in two or three dimensions as well. FIG. 5 shows a two dimensional ladder. The electrodes form vertical columns 72, 74 which, in pairs, correspond to the one-dimensional ladder array of FIG. 2. Electrodes are interconnected horizontally in rows 76, 78 to allow matrix addressing of a particular position. The result of this configuration is to allow the vertical manipulation of a bubble 80 of high dielectric material, shown on the left, at any horizontal position in the device.

Figure 6:
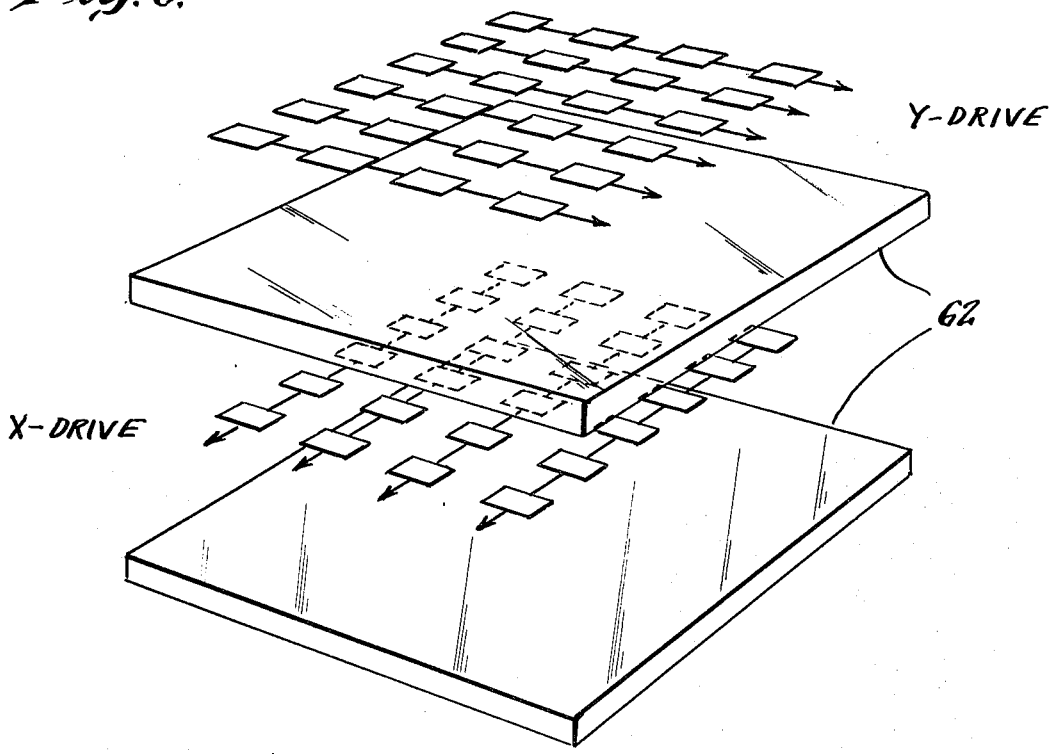
FIG. 6 is an exploded view of an electrode useful in the present invention.

More flexibility is possible with multiple arrays, as shown in FIG. 6. Two ladder arrays, one for driving in the x-direction and the other for driving in the y-direction, are separated by an insulator, 62. This combination of arrays is substituted for one of the single array electrodes used in FIG. 5, resulting in full x-y mobility. Three dimensional manipulation is possible by several means. The most obvious is to incorporate the vertical positioning design shown in FIG. 4 with the array configuration shown in FIG. 6. A simpler and preferable way is to stack together a series of one or two dimensional arrays, giving the effect of a three-dimensional final array of positions.

Special consideration must be placed on the effects of surface wetting or adhesion, surface tension, and viscosity in a dielectrophoretic manipulator. To first order, all electrically neutral materials attract each other, to a greater or lesser degree, by the Van der Waals interaction, which is the microscopic counterpart of the dielectrophoretic interaction. Because of this attraction, any material which is to be manipulated will tend to be attracted to the containing surfaces of the device. That attraction can cause adhesion to, or in the case of fluids, wetting of, the containing surfaces by the material to be manipulated, which degrades the performance of the device. To overcome this effect, a secondary material may be placed between the material being manipulated and the containing surfaces. This secondary material has the characteristic that it is more attractive to the material being manipulated than are the containing surfaces. This secondary material may take the form of a lubricant that coats the containing surfaces, or of a low viscosity fluid (or gas) that fills the volume between the containing surfaces. For example, if water, with a dielectric constant of 76, is the material to be manipulated, and glass insulators form the containing surfaces, a surrounding fluid that is effective at preventing the water from wetting the glass is heptane, with a dielectric constant of 1.9, containing five percent octyl alcohol. It is important to keep the viscosity of the surrounding material as low as possible to afford the least resistance to the movement of the material being manipulated.

Although the first and second materials can have arbitrary densities, it is preferable to closely match their densities to minimize the effects of gravity and vibration on the materials.

Finally, if the material being manipulated is fluid, there may be a requirement to generate small bubbles from larger ones. This can be accomplished by at least four techniques. Moving a fluid bubble rapidly in a viscous medium causes the larger bubble to break down into smaller ones due to viscous drag. The velocity required to perform this fissioning process depends upon the surface energy between the bubble and the surrounding medium. For example, in the case of water in heptane, the addition of two percent of the detergent Triton-x 100 to the water lowers the surface energy between the water and the heptane from more than thirty to less than ten dynes per centimeter. Another technique for fissioning bubbles is to use neighboring inhomogeneous field regions. Roughly speaking, bubbles will split in two if it is energetically favorable to occupy separate regions of a higher field. If a bubble is charged, it can break up into smaller bubbles due to mutual repulsion of the like charges on the original bubble. Alternative techniques for creating small bubbles include forcing the fluid through a small orifice.

The preceding description is applicable to all devices utilizing dielectrophoretic manipulation. Certain considerations are specifically appropriate for creating visual electronic displays, and these will now be discussed.

To display information, the position of the material being manipulated must be visible. This requires that the supporting surfaces and insulators should be at least partially transparent. The manipulated material might be moved to and from a region masked from view. This suggests the use of clear support structures such as glasses and plastics. Similarly, at least one of the electrodes must be optically clear. An example of such clear electrodes are the tin-indium-oxides used in liquid crystal display electrodes. If arrays are to be stacked so as to present a three dimensional image, it is clear that the electrdoes and support structures must be substantially transparent to allow all layers of the array to be visible.

The material being manipulated must be visually distinguishable from the surrounding material. The two general techniques for achieving this are to have the manipulated material absorb, scatter, or emit light, while immersed in a transparent surrounding material, or in contrary fashion, to have a transparent manipulated material in an absorbing, scattering or emitting surrounding fluid. For a three-dimensional display, or for any device which is to project an image, (a technique described below), it is important that the refractive index of the transparent material be matched to that of the supporting material, so as to avoid distortion of transmitted light.

A variety of possibilities exist for lighting this display. Since the display is passive, light must be supplied to it from some source to allow it to be visible. Ambient lighting can be used, with an absorbing, reflecting, transmitting, or scattering backing. Diffuse back- or front-lighting can give additional illumination in low light environments. Light can be pumped into the edge of the display by a variety of different sources. Because the display is predominantly transparent and has an index greater than the surrounding air, the light will be trapped inside the display until it is coupled out by the manipulated material, due to the fact that scattering or luminescing substances are contained in the manipulated material. Another geometry consists of a collimated or point light source which projects through the display onto a screen or diffuse plate. The principle advantage of the latter technique is a considerable increase in the effective speed of motion, with, of course, a commensurate loss in resolution.

Figure 7:
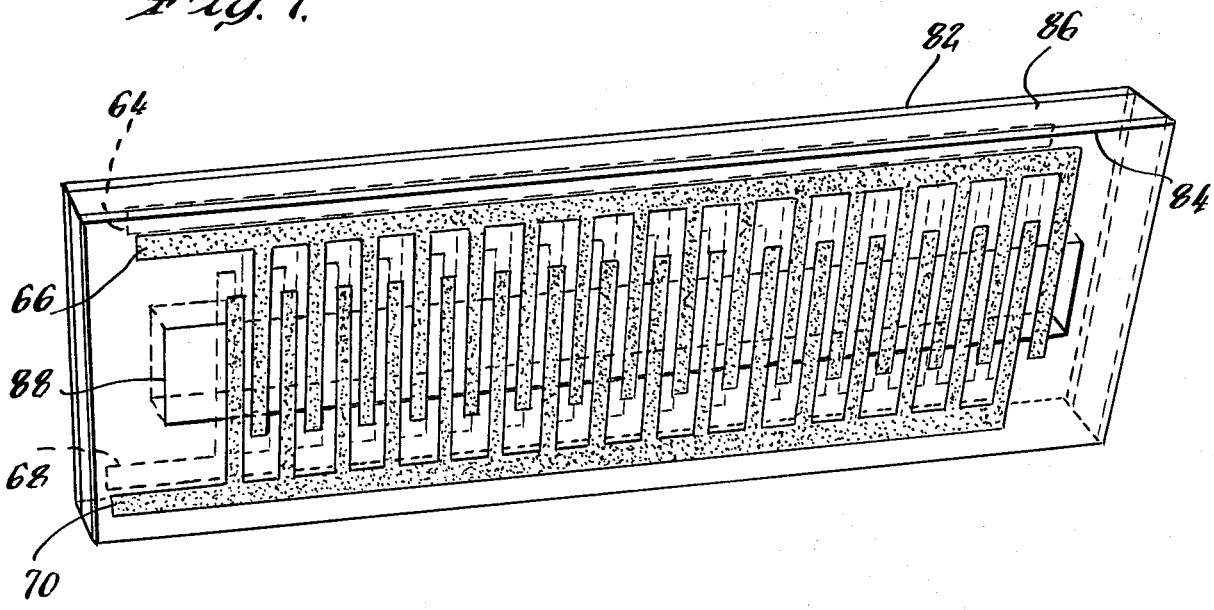
FIG. 7 is a perspective view of a dielectrophoretic display of visual information in accordance with the present invention.

A method for construction of an operational version of a dielectrophoretic display, as shown in FIG. 7, will now be described. Electrode patterns 64, 66, 68, 70 with finger widths of 10 mils are etched into tin-indium-oxide conductors on soda-lime glass plates 82, 84, using a nitric and hydrochloric acid etch and standard photolithographic techniques. Insulators (not shown) are used between the electrodes and the fluid, and are made from borosilicate microscope cover-slips treated with the agent 'Glas-Treat' (a trademark of Regis Chemical Company) to make the surface hydrophobic. Contact from the clear electrodes to the drive circuits is made with a conductive elastomer. A teflon gasket 86 one sixteenth of an inch in thickness separates the two insulating slides and defines a fluid reservoir 88. The manipulated material is water containing one percent Triton-X 100 and 0.01 percent rhodamine-6G for color. The surrounding fluid is heptane containing five percent octyl alcohol. The drive voltage is a 10 kilohertz 120 volt square wave. Electrodes signified as V+ in Table 1 are in phase, and those signified by V− are 180 degrees out of phase. (The bubbble of higher dielectric material has been omitted from FIG. 7 for clarity.)

Placing either the forward or reverse sequence of voltages from Table 1 on the electrodes, (64, 66, 68, and 70), will cause the bubble to move to the right or the left, respectively. This, then, is a simple one-dimensional display which might represent, for example, the level of an analog signal by the position of the bubble. A more complex version of the same design would allow the generation of graphics and alpha-numerics.

The above description is intended to be illustrative and not restrictive of the scope of the invention, that scope being defined by the following claims and all equivalents thereto.

What is claimed is:

1. A dielectrophoretic display comprising:

a housing formed, at least in part, from a light transmissive material;

a first electrically neutral material within said housing having a first dielectric constant;

a second electrically neutral material within said housing having a second dielectric constant different from that of said first material, said second material being visually distinguishable from said first material; and means for selectively applying a non-uniform electrical field within said housing to cause relative movement of said first and second materials, including translational movement, as a result of dielectrophoretic forces resulting from said electrical field;

said means for applying said non-uniform field including at least one electrode and means for selectively varying the charge on said at least one electrode for applying a non-uniform field to said first and second materials;

said first and second materials being electrically neutral both before and during the application of said non-uniform electrical field thereto;

whereby the relative positions of said first and second materials may be established by said electrical field to present visually identifiable information.

2. The display of claim 1 further including means for varying said electrical field.

3. The display of claim 1 wherein said second material is a fluid.

4. The display of claim 3 wherein said first and second materials are liquid, said first material having a higher viscosity than said second material.

5. The display of claim 3 wherein said first material is a solid.

6. The display of claim 1 wherein said first material includes a light absorber and said second material is substantially transparent.

7. The display of claim 1 wherein said first material includes a luminescing material.

8. The display of claim 1 wherein said first and second materials are of substantially the same densities to minimize the effects of gravity and vibration on said materials.

9. The display of claim 1 wherein said first material includes means for scattering impinging light.

10. The display of claim 9 wherein said means for scattering includes titanium dioxide.

11. The display of claim 1 wherein said means for applying said non-uniform electrical field includes at least two oppositvely charged electrodes, and means for selectively and independently adjusting the magnitude and polarity of charge on each of said electrodes.

12. The display of claim 1 further including an insulating material disposed between said field creating means and said first and second materials.

13. The display of claim 12 wherein one of said first and second materials contains water, and further including a hydrophobic agent applied to the inner surfaces of said insulating material to prevent wetting of said surfaces.

14. The display of claim 13 wherein said insulating material and said field creating means are both formed, at least in part, from a light transmissive material.

15. The display of claim 1 further including more than two materials within said housing, at least two of said materials having different dielectric constants.

16. The display of claim 15 wherein each of said materials within said housing has a dielectric constant different from that of each of the other materials in said housing.

17. The display of claim 1 wherein said field applying means is positioned to cause relative movement of said first and second materials in two dimensions.

18. The display of claim 1 wherein said field applying means is positioned to cause relative movement of said first and second materials in three dimensions.

19. A method of visually displaying information including the steps of:

providing a first electrically neutral material having a first dielectric constant;

providing a second electrically neutral material having a second dielectric constant different from that of said first material, said second material being visually distinguishable from said first material;

providing at least one electrode and means for selectively varying the charge on said electrode for applying a non-uniform field to said first and second materials;

varying the charge on said electrode for creating dielectrophoretic forces to cause relative movement of said first and second materials, including translational movement, resultant from said non-uniform field applied thereto;

said first and second materials being electrically neutral both before and during the application of said non-uniform field applied thereto;

whereby the relative positions of said first and second materials present a visual display of information.

20. The method of claim 19 further including the step of enclosing said first and second materials in a housing formed, at least in part, from a light transmissive material.

21. The method of claim 19 including the step of varying the non-uniform field applied to said first and second materials to thereby change the visual display of information.

* * * * *